US008342419B2

(12) United States Patent
Simensen et al.

(10) Patent No.: US 8,342,419 B2
(45) **Date of Patent: *Jan. 1, 2013**

(54) PREFABRICATED STAND FOR HYDRONIC SYSTEMS

(76) Inventors: Thomas O. Simensen, Kalispell, MT (US); Torbjorn O. Simensen, Kalispell, MT (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/397,977

(22) Filed: Mar. 4, 2009

(65) Prior Publication Data

US 2009/0165291 A1 Jul. 2, 2009

Related U.S. Application Data

(63) Continuation of application No. 10/851,264, filed on May 21, 2004.

(51) Int. Cl.
*F16K 11/10* (2006.01)
*F24D 3/10* (2006.01)

(52) U.S. Cl. ..... 237/69; 122/510; 248/154; 248/240

(58) Field of Classification Search ..... 248/148, 248/154, 235, 240, 240.2, 240.4, 241, 176.1, 248/176.2, 311.2; 108/38, 40; 297/147, 297/14, 60; 190/12 R; 237/69, 66; 122/510
See application file for complete search history.

(56) References Cited

U.S. PATENT DOCUMENTS

| | | | | | |
|---|---|---|---|---|---|
| 193,046 | A | * | 7/1877 | Smith | 248/240.4 |
| 1,593,375 | A | * | 7/1926 | Wood | 248/241 |
| 2,186,860 | A | * | 1/1940 | Evans | 237/8 R |
| 2,512,108 | A | * | 6/1950 | Liptay | 248/413 |
| 3,242,882 | A | * | 3/1966 | Hoyt | 108/48 |
| 3,324,483 | A | * | 6/1967 | Conroy | 4/638 |
| 3,884,438 | A | * | 5/1975 | Logsdon | 248/59 |
| 4,009,903 | A | * | 3/1977 | Manspeaker | 297/14 |
| 4,019,681 | A | * | 4/1977 | Dumser et al. | 237/63 |
| 4,091,840 | A | * | 5/1978 | Grove et al. | 137/561 R |
| 4,550,710 | A | * | 11/1985 | McDonald, II | 122/13.01 |
| H239 | H | | 3/1987 | Franklin et al. | |
| 4,756,475 | A | * | 7/1988 | Vergne | 237/56 |
| 4,770,341 | A | | 9/1988 | Drake | |
| 4,907,739 | A | | 3/1990 | Drake | |
| 5,366,152 | A | * | 11/1994 | Gossi | 237/2 B |
| 5,383,689 | A | * | 1/1995 | Wolfe, Sr. | 285/124.3 |
| 5,390,660 | A | | 2/1995 | Danielson | |
| 5,460,204 | A | * | 10/1995 | Rossi | 137/884 |

(Continued)

FOREIGN PATENT DOCUMENTS

DE 4237650 A1 * 4/1993

(Continued)

OTHER PUBLICATIONS

WIRSBO proPANEL Series overview; uponor; pp. 1-2; 6001-2004 Wirsbo systems.*

(Continued)

*Primary Examiner* — Carl Price
(74) *Attorney, Agent, or Firm* — Cardinal Law Group; Anne K. Burkhart

(57) ABSTRACT

A stand assembly for hydronic circulation systems includes a fixed back portion. A selectively movable platform portion is connected to the back portion. The stand assembly is selectively movable between a folded shipping position and an unfolded installation position by selectively moving the platform portion.

13 Claims, 6 Drawing Sheets

U.S. PATENT DOCUMENTS

| | | | | | |
|---|---|---|---|---|---|
| 5,529,088 | A | * | 6/1996 | Asou | 137/343 |
| 5,553,892 | A | * | 9/1996 | Pitchford et al. | 285/12 |
| 5,707,007 | A | * | 1/1998 | Fiedrich | 237/81 |
| 5,838,880 | A | * | 11/1998 | Brooks et al. | 392/485 |
| 5,950,575 | A | * | 9/1999 | Simons et al. | 122/511 |
| 5,964,402 | A | * | 10/1999 | Jakobson | 237/69 |
| 6,126,081 | A | * | 10/2000 | Calvin et al. | 237/12.3 B |
| 6,167,762 | B1 | * | 1/2001 | Miyazoe | 73/756 |
| 6,299,071 | B1 | * | 10/2001 | Fiedrich | 237/8 R |
| 6,325,297 | B1 | * | 12/2001 | Calvin et al. | 237/12.3 B |
| 6,345,770 | B1 | * | 2/2002 | Simensen | 237/69 |
| 6,347,748 | B1 | * | 2/2002 | Lyons | 237/69 |
| 6,546,898 | B1 | * | 4/2003 | Rocheleau | 122/235.29 |
| 6,557,774 | B1 | * | 5/2003 | Krueger | 237/66 |
| 6,761,135 | B1 | * | 7/2004 | Becktold | 122/396 |
| 7,191,789 | B2 | * | 3/2007 | Corbett, Jr. | 137/15.01 |
| 7,261,121 | B2 | * | 8/2007 | Bordonaro et al. | 137/269 |
| 7,407,003 | B2 | * | 8/2008 | Ross | 165/295 |
| 7,661,441 | B2 | * | 2/2010 | Simensen et al. | 137/884 |
| 2003/0056826 | A1 | * | 3/2003 | Thomas | 137/360 |
| 2006/0196959 | A1 | * | 9/2006 | Sweet | 237/67 |
| 2007/0147809 | A1 | * | 6/2007 | Rixen | 392/496 |

FOREIGN PATENT DOCUMENTS

| | | | | |
|---|---|---|---|---|
| DE | 202 11 303 | | * | 1/2003 |
| EP | 57169 | A1 | * | 8/1982 |
| EP | 236235 | | * | 9/1987 |
| EP | 371715 | A1 | * | 6/1990 |
| EP | 561037 | A1 | * | 9/1993 |
| EP | 584459 | A1 | * | 3/1994 |
| JP | 03233231 | A | * | 10/1991 |

OTHER PUBLICATIONS

A.I.M. Radiant Heating; Preassembled Boiler Room in a Box; 5 pages; AIM Radiant Haeting 6591 Route 23 Acra, NY 12405.*

Internet Archive WAYBACH MACHINE search results; "Preassembled Boiler Room in a Box"; http://www.aimradiantheating.com/store/preassembled.html; May 21, 2001; http://web.archive.org/web/20010512201347/http://www.aimradiantheating.com/store/preassembled.html.*

Internet Archive WAYBACH MACHINE search results; "Preassembled Boiler Room in a Box"; http://www.aimradiantheating.com/store/preassembled.html; Jun. 15, 2002; http://web.archive.org/web/20010512201347/http://www.aimradiantheating.com/store/preassembled.html.*

WIRSBO proPANEL Series Overview; uponor; pp. 1-2; 2001-2004 Wirsbo systems.*

A.I.M. Radiant Heating; Preassembled Boiler Room in a Box; 5 pages; AIM Radiant Haeting 6591 Route 23 Acra, NY 12405; Jun. 15, 2002.*

* cited by examiner

PREFABRICATED STAND FOR HYDRONIC SYSTEMS

CROSS-REFERENCE TO RELATED APPLICATIONS

This Application is a Continuation of and claims priority to U.S. application Ser. No. 10/851,264 filed May 21, 2004 to Thomas O. Simensen and Torbjorn O. Simensen entitled Prefabricated Stand for Hydronic Systems, currently pending, the entire disclosure of which is incorporated herein by reference.

FIELD OF THE INVENTION

The invention relates generally to components for hydronic systems. Specifically, the invention relates to stands for supporting hydronic heating system components.

BACKGROUND OF THE INVENTION

The advantages of hydronic heating systems are well-known. Hydronic systems offer levels of comfort, efficiency, and quiet operation that are seldom obtained by forced-air arrangements. Unfortunately, those advantages are offset, at least in part, by the relatively high installation costs of hydronic systems. Hydronic systems typically include a boiler supplying heat exchange medium to in-floor or baseboard heat exchangers. Conduits, pumps, and valves are connected to circulate the heat exchange medium between the boiler and the heat exchangers. Customarily, the conduits, pumps, and valves are collected and assembled on-site. Many applications require on-site fabrication of a boiler stand as well (for example, when system components are located in a garage). Such custom fabrication is typically performed by, or under the direct supervision of, a licensed plumbing professional. The time and effort required add substantially to the installation costs of the system.

Some efforts have been made to reduce the amount of on-site work needed in hydronic systems. For example, U.S. Pat. No. 5,390,660 to Danielson is directed to a pre-wired and pre-plumbed module for connection to an installed hydronic radiant floor heating system including a supporting frame having components mounted thereon such as a boiler, pumps, four-way valve, in-line air separator, expansion tank, P/T ports, return valves, supply valves and control panels mounted thereon. The module is assembled at the factory and is tested at the factory to ensure that the components are properly plumbed and wired. Once the module is delivered to the job site, the components of the module are quickly and easily connected to the hydronic radiant floor heating system.

U.S. Pat. No. 4,907,739 to Drake discusses a radiant heating system especially useful for floor heating is provided with a fluid flow apparatus that includes means for pumping a fluid such as water, a temperature-responsive actuator and a valve positionable within a valve housing in response to measured fluid temperature. The system includes heat transfer means, typically a tube embedded in the floor that receives heated fluid from the flow apparatus which in turn receives fluid at generally a higher temperature from a fluid heating apparatus such as a water boiler. The amount of heated fluid recirculated to the heat transfer means is controlled by the position of the valve in the valve housing.

U.S. Pat. No. 4,770,341 to Drake sets forth a manifold which is useful in receiving a heated liquid such as warm water from a suitable source and for distributing that liquid to a plurality of floor heat exchangers and for receiving liquid from the heat and returning that liquid to the source. The manifold includes a plurality of separate manifold elements that can be stacked adjacent one another, each element having a first and second chamber. The first and second chambers of the elements together define first and second distribution vessels within the manifold. Each manifold element includes inlet and outlet ports communicating with the respective distribution vessels for carrying liquid to and from the heat exchangers. The manifold elements desirably are integrally formed from plastic or other material exhibiting a coefficient thermal conductivity of less than 1.0 kcal/M·h° C.

U.S. Patent No. H1239 to Franklin is directed to a hydronic heating system that includes a tube or series of tubes placed on modular composite panels. The panels are fabricated with a grooved surface to permit the flush embedment of the tubes on the panels.

U.S. Pat. No. 6,345,770 to Simensen, the specification of which is incorporated by reference herein, discusses a modular manifold adapted for use with hydronic circulation systems including a plurality of first and second thermal exchange zones having respective zone supply and zone return lines. The modular manifold includes a plurality of modules, each of which includes a selectively actuatable fluid control mechanism having an inlet and an outlet. The outlet of each selectively actuatable fluid control mechanism is in fluid communication with a respective zone supply line of the zone of the hydronic circulation system. Each module further includes a common return conduit section secured to the selectively actuatable fluid control mechanism. A common supply conduit section is secured to the selectively actuatable fluid control mechanism of each module. The common supply conduit section is in fluid communication with the inlet of the selectively actuatable fluid control mechanism. The modules are adapted and constructed to be connected together, with the collective common return conduit sections fitting together to form a common return conduit in communication with the return lines of the thermal exchange zones, and the collective common supply conduit sections fitting together to form a common supply conduit. The selectively actuatable fluid control mechanisms can be provided as any suitable control mechanism, such as zone pumps or zone valves. A connecting conduit having a first end connected to the common return conduit and a second end connected to the common supply conduit can be provided in the form of a U-bend. An injection mechanism having an inlet connected to a source of thermal exchange fluid and an outlet connected to the connecting conduit can also be provided. The injection mechanism can be provided as an injection pump or an injection mixing valve. A temperature gauge can be connected to the connecting conduit at a location downstream from the injection mechanism outlet. The temperature gauge indicates the temperature of fluid flowing into the common supply conduit. Tee connectors can be provided to connect the modules together, and can include a return inlet conduit connected to the zone return line of the first thermal exchange zone.

Although these arrangements offer some advantages over standard heating and cooling systems, many are complex and expensive. It can be seen from the foregoing that the need exists for a simple, inexpensive stand for hydronic systems that provides fabrication and installation advantages, overcoming the deficiencies of known arrangements.

SUMMARY OF THE INVENTION

These and other objects are achieved by providing a stand assembly for hydronic circulation systems including a fixed back portion. A selectively movable platform portion is connected to the back portion. The stand assembly is selectively movable between a folded shipping position and an unfolded installation position by selectively moving the platform portion.

The features of the invention believed to be patentable are set forth with particularity in the appended claims. The invention itself, however, both as to organization and method of operation, together with further objects and advantages thereof, may best be understood by reference to the following description, taken in conjunction with the following drawings.

DETAILED DESCRIPTION OF THE INVENTION

Figure 1:
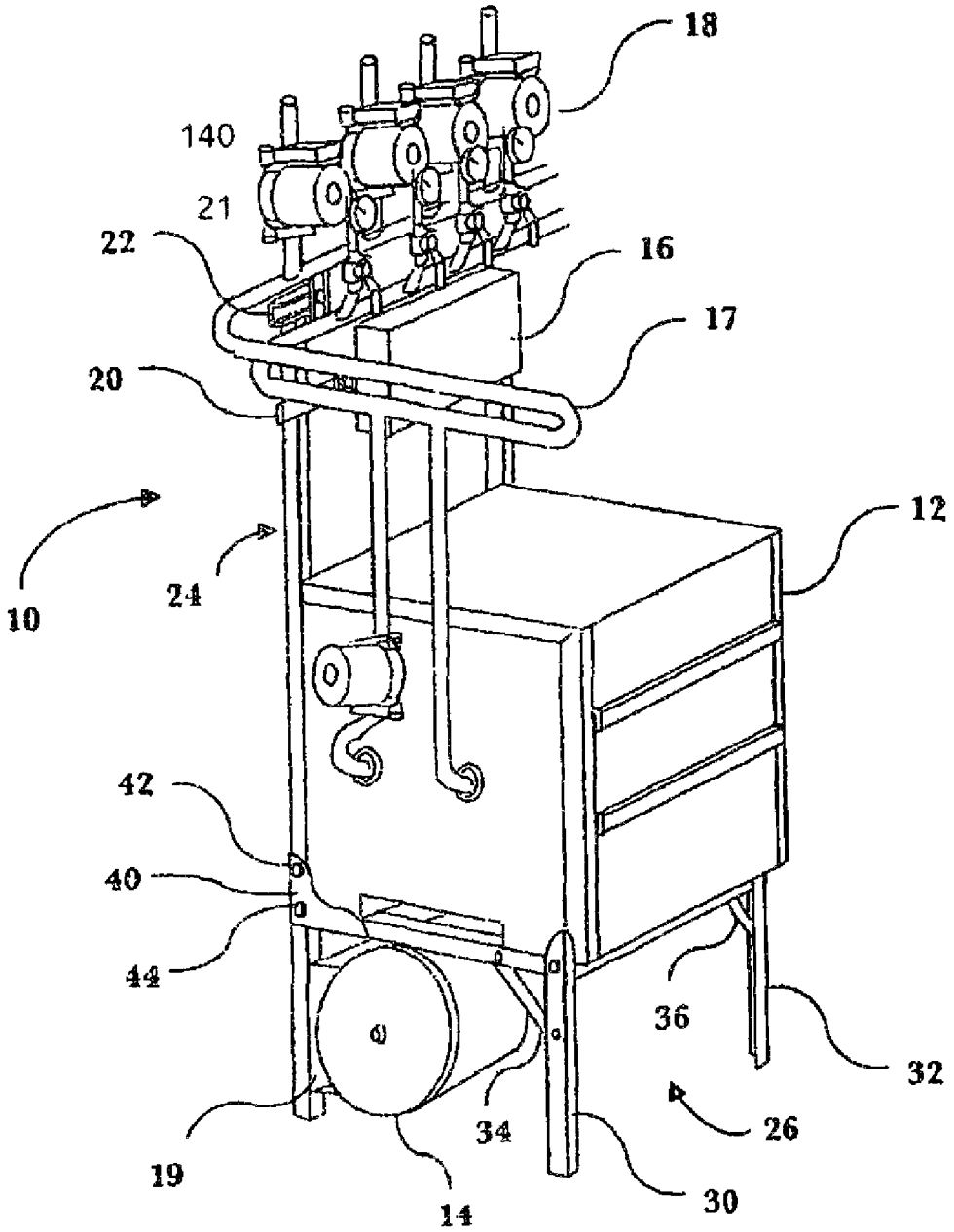
FIG. 1 illustrates a schematic perspective view of a hydronic system and stand assembly embodying the principles of the present invention.

FIG. 1 illustrates a stand assembly 10 incorporating the principles of the present invention. The stand assembly 10 supports a variety of hydronic system components, including a boiler 12, an expansion tank 14, an electronic control panel 16, a primary loop module 17, and a zone manifold module 18. The expansion tank 14 is secured to the stand assembly 10 via a tank mounting bracket 19. The electronic control panel 16 is secured to the stand assembly 10 via an electronics mounting bracket 20. The zone manifold module 18 can secured to the stand assembly 10 via a conventional manifold mounting mechanism such as a uni-strut 22, or as described with reference to a specific zone manifold module.

Figure 2:
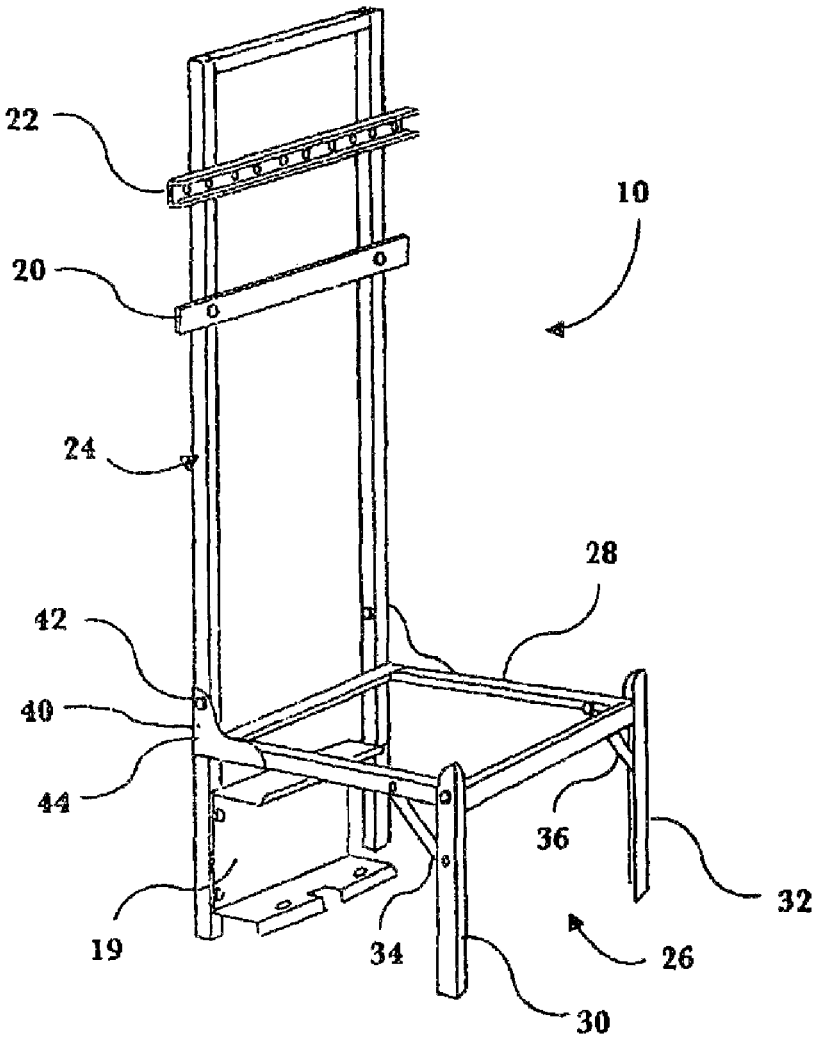
FIG. 2 illustrates a schematic perspective view of a stand assembly embodying the principles of the present invention.
Figure 3:
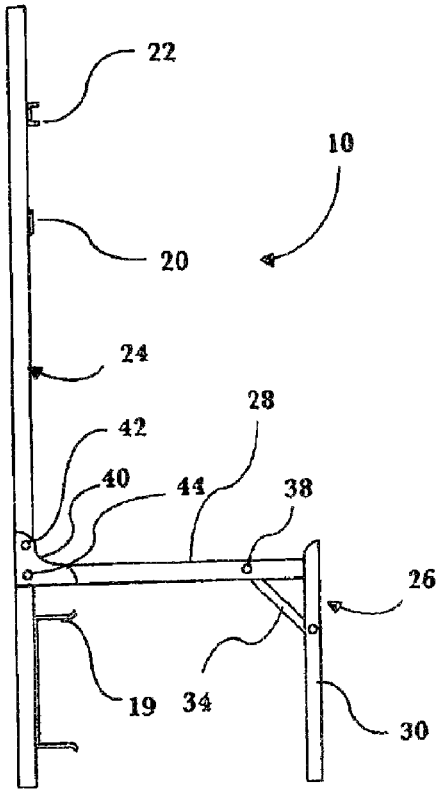
FIG. 3 illustrates a schematic side elevational view of a stand assembly in its installation position.
Figure 4:
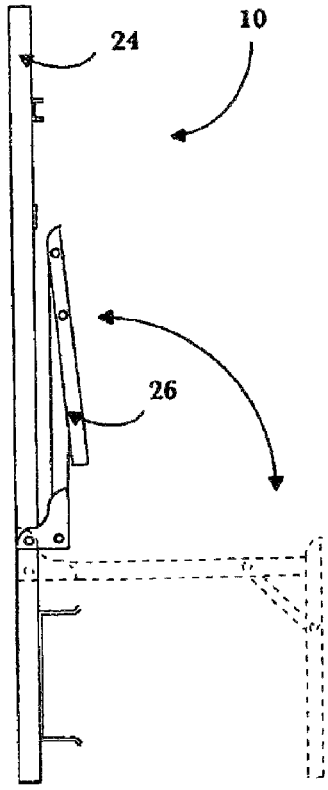
FIG. 4 illustrates a schematic side elevational view of a stand assembly in its shipping position.

Details of the stand assembly 10 are shown in FIGS. 2 through 4. The stand assembly 10 includes a fixed back portion 24. A selectively movable platform portion 26 is connected to the back portion 24.

The platform portion 26 includes a platform 28 adapted and constructed to support the boiler 12. The dimensions of the platform can be selected for compatibility with the products of major boiler manufacturers. The platform portion 26 also includes a pair of front legs 30, 32 at the front corners of the platform 28. The legs 30, 32 support the front portion of the platform 28, and are secured to the platform 28 by respective braces 34, 36 by suitable fasteners 38, which can be provided as threaded bolt assemblies, cotter pin assemblies, and the like.

A hinge bracket 40 secures the platform portion 26 to the back 24. In the illustrated embodiment, the hinge portion 40 is fixedly secured to the platform 28. A hinge pin 42 movably connects the hinge bracket 40 to the base 24. A locking pin 44 is provided to selectively lock the hinge bracket 40 with respect to the base 24 when the stand assembly 10 is in its installation position, as shown in FIGS. 2 and 3.

Operation of the stand assembly 10 is as follows. The stand assembly 10 is fabricated at a fabrication location, such as a manufacturing facility. If the stand assembly 10 is to be shipped, the locking pin 44 and at least one of the fasteners 38 on each of the leg/brace combinations are removed. The stand assembly 10 can then be folded into its shipping position, shown in FIG. 4. The stand assembly 10 is then brought to an installation location, e.g., the home or business at which the hydronic system is being installed. If necessary, the stand is then unfolded to its installation position (shown in FIG. 2 and in broken line in FIG. 3), and the locking pins 44 and fasteners 38 re-secured. The stand assembly 10 is then placed in its installation location. This may entail merely placing the stand assembly 10 into a specific place in a boiler room, garage, basement, crawl space, or the like, and/or securing the stand assembly 10 to a nearby wall in a desired location. Once the stand assembly is installed in place, the various components of the hydronic system can be in turn installed and aligned on the stand assembly 10. as illustrated, for example, in FIG. 1 of U.S. Pat. No. 7,661,441 incorporated herein.

It is contemplated that particular advantage may be achieved in the concurrent use of a prefabricated manifold assembly for the zone and primary loop manifolds, as described in Applicant's concurrently-filed application, now U.S. Pat. No. 7,661,441, the entirety of which is incorporated by reference herein.

Figure 5:
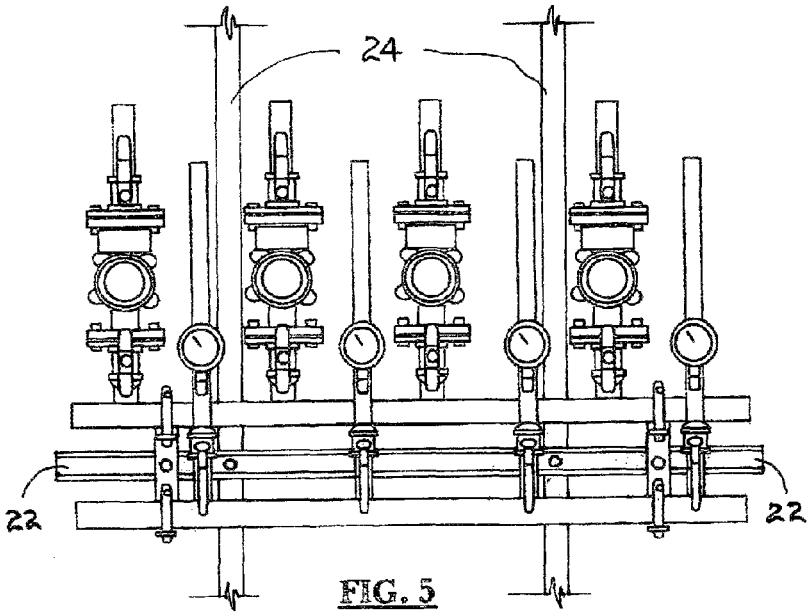
FIG. 5 illustrates a front partial elevation view of the stand assembly of FIG. 1.

The stand assembly of the present invention provides numerous advantages. For example, the stand allows for some customization of components, since the mounting members such as the uni-strut and electronics bracket can be either secured at the fabrication location or on site. The provision of an expansion tank bracket beneath the stand solves the long-standing problem of expansion tank location. FIG. 5 illustrates a modular manifold component with flow control mechanisms in place. In this embodiment, the modular manifold 100 includes a plurality of control conduit sections 102-108 adapted and constructed to receive any of a plurality of selectively actuatable fluid control mechanisms. Such selectively actuatable fluid control mechanisms can include mixing valves, injection valves, check valves, isolation valves, and the like. Each of the control conduit sections 102-108 has an inlet connected to a supply conduit section 110. A plurality of additional control conduit sections 112-118 are connected to a return conduit section 120.

Figure 6:
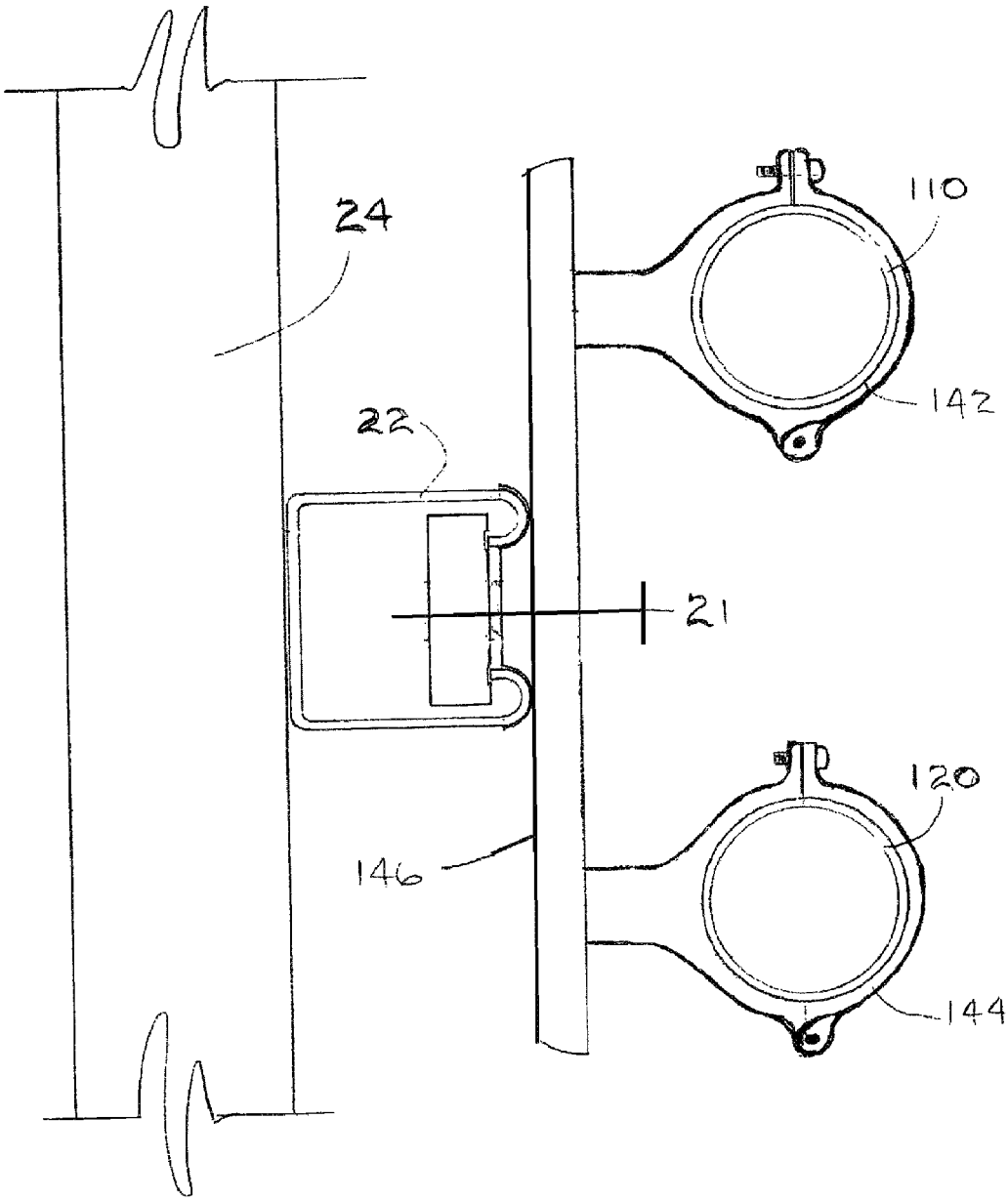
FIG. 6 illustrates a side sectional view of the stand assembly of FIG. 1.
Figure 7:
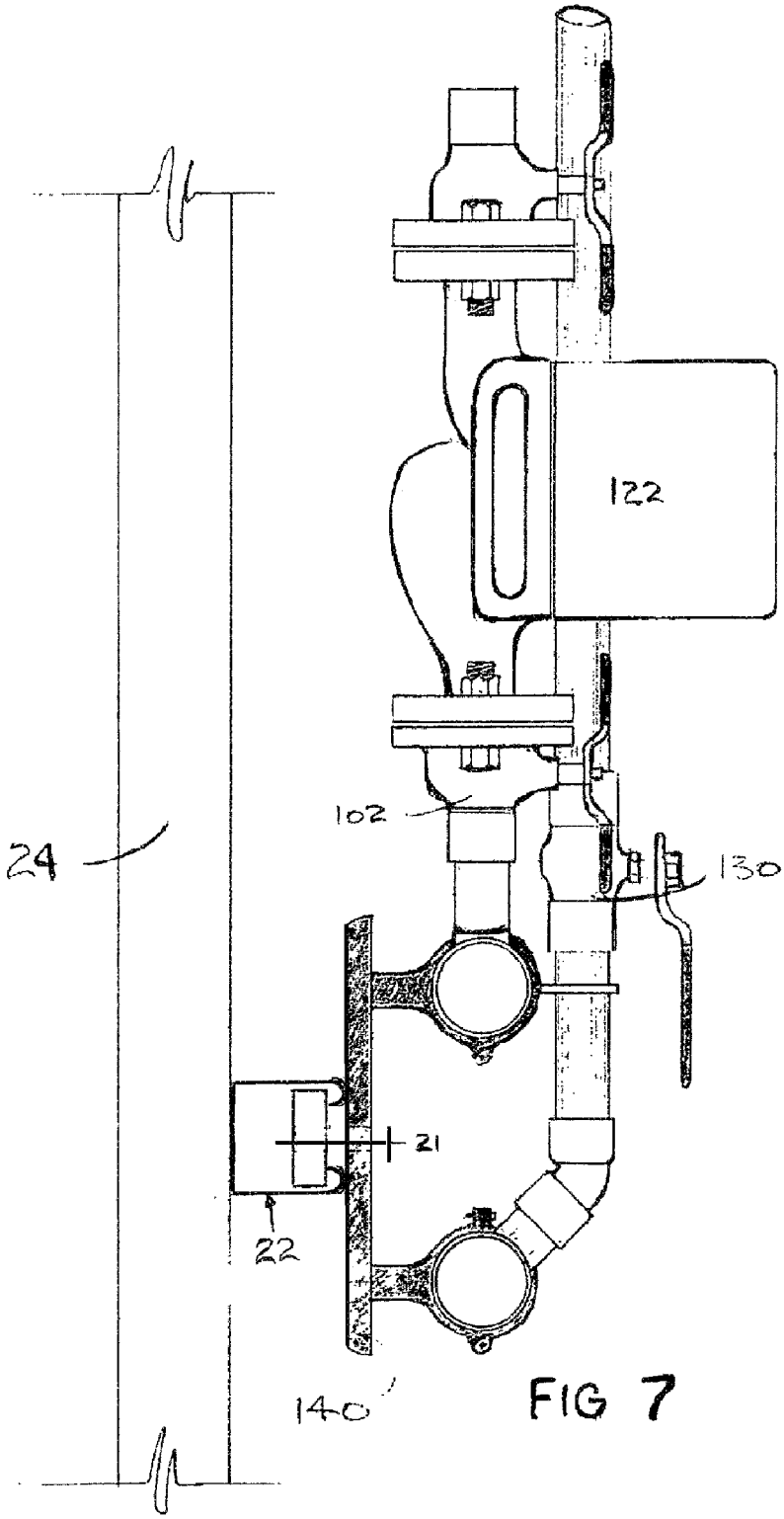
FIG. 7 illustrates a sectional view of FIG. 5.

The modular manifold 100 can accept any of a plurality of selectively actuatable fluid control mechanisms. As shown in FIG. 5, pumps 122-128 are connected to the control conduit sections 102-108, and valves 130-138 are connected to control conduit sections 112-118. The supply conduit section 110 and the return conduit section 120 are secured together via a conduit bracket 140 and suitable fastener 21, as shown in FIG. 6 and FIG. 7. The conduit bracket 140 includes respective clamps 142, 144 connected by a central casting 146. The conduit bracket 140 is adapted and constructed to secure the manifold 100 to a standard attachment mechanism 22, such as a uni-strut.

The various elements of the stand assembly as shown can be fabricated from any suitable materials, chosen for strength, durability, and ease of manufacture. For example, the back portion 24 can be fabricated from 1.5-inch U-channel steel. The platform 28 and legs 30, 32 can be fabricated from 1.5" L-channel steel. The braces 34, 36 and hinge brackets 40 can be fabricated from ¼" plate steel.

Although the present invention has been described with reference to specific embodiments, those of skill in the art will recognize that changes may be made thereto without departing from the scope and spirit of the invention as defined by the appended claims.

What is claimed is:

1. A method for assembling a hydronic circulation system, the method comprising the following steps:

fabricating a stand assembly, adapted and constructed to support the hydronic circulation system, the hydronic circulation system including a modular manifold component, the component comprising a control conduit section adapted and constructed to receive a selectively actuable fluid control mechanism selected from a group consisting of mixing valves, injection valves, check valves, isolation valves, circulators and zone valves, the control conduit section having an inlet and an outlet; a return conduit section secured to the control conduit section in fluid communication with the inlet of the control conduit section; a supply conduit section secured to the control conduit section in fluid communication with the inlet of the control conduit section; and wherein the control conduit further comprises an outlet section adapted and constructed to selectively receive the selectively actuable fluid control mechanism via at least one of an upper and a lower receiving end of the outlet of the control conduit section, at a fabrication location;

bringing the stand assembly to an installation location located remotely from the fabrication location;

installing the stand assembly at the installation location by selectively connecting the stand assembly to modular components of the hydronic circulation system; and installing components of the hydronic circulation system on the stand at the installation location.

2. A method in accordance with claim 1, further comprising the following step:

fabricating a modular assembly at the fabrication location;

bringing the modular assembly to the installation location; and installing the modular assembly on the stand.

3. A method in accordance with claim 2, wherein the step of installing components of the hydronic system includes installing a control panel on the stand.

4. A method in accordance with claim 1, wherein the step of fabricating the stand assembly further comprises the step of securing a manifold mounting mechanism on the stand.

5. A stand assembly for hydronic circulation systems including at least one zone manifold module, the stand assembly including the following:

a fixed back portion; and a removable, movable platform selectively connected to the fixed back portion, whereby the removable platform is connected to the fixed back portion during installation to form the stand assembly, and whereby the stand aligns and supports all the modular components, including the modular manifold component of claim 1, into a complete hydronic circulation system.

6. A stand assembly in accordance with claim 5, wherein the back portion further comprises at least one mounting member.

7. A stand assembly in accordance with claim 6, wherein the at least one mounting member comprises a uni-strut.

8. A stand assembly in accordance with claim 6, wherein the at least one mounting member comprises an electronics mounting base.

9. A stand assembly in accordance with claim 6, wherein the at least one mounting member comprises a tank bracket.

10. A stand assembly according to claim 5, wherein the removable platform comprises the following:

a platform adapted and constructed to support a boiler; and a hinge bracket securing the platform to the back.

11. A stand assembly according to claim 10, further comprising the following:

a hinge pin movably connecting the hinge bracket to the base; and a locking pin selectively locking the hinge bracket with respect to the base.

12. A stand assembly according to claim 10, the platform further comprising:

at least one leg connected to the platform; and at least one brace connected between the at least one leg and the platform.

13. A stand assembly in accordance with claim 12, wherein the at least one leg comprises a pair of front legs, and the at least one brace comprises a pair of braces.

* * * * *